US011007567B2

(12) United States Patent
Ishibashi

(10) Patent No.: US 11,007,567 B2
(45) Date of Patent: May 18, 2021

(54) DIE CASTING MACHINE

(71) Applicant: Ube Machinery Corporation, Ltd., Ube (JP)

(72) Inventor: Naoki Ishibashi, Ube (JP)

(73) Assignee: Ube Machinery Corporation, Ltd., Ube (JP)

( * ) Notice: Subject to any disclaimer, the term of this patent is extended or adjusted under 35 U.S.C. 154(b) by 22 days.

(21) Appl. No.: 16/321,881

(22) PCT Filed: Jul. 21, 2017

(86) PCT No.: PCT/JP2017/026576
§ 371 (c)(1),
(2) Date: Jan. 30, 2019

(87) PCT Pub. No.: WO2018/025677
PCT Pub. Date: Feb. 8, 2018

(65) Prior Publication Data

US 2019/0176225 A1 Jun. 13, 2019

(30) Foreign Application Priority Data

Aug. 4, 2016 (JP) ..... JP2016-153275

(51) Int. Cl.

| | |
|---|---|
| ***B22D 17/14*** | (2006.01) |
| ***B22D 17/20*** | (2006.01) |
| ***B22D 17/10*** | (2006.01) |
| ***B22D 17/26*** | (2006.01) |

(52) U.S. Cl.
CPC ..... *B22D 17/145* (2013.01); *B22D 17/10* (2013.01); *B22D 17/14* (2013.01); *B22D 17/203* (2013.01); *B22D 17/263* (2013.01)

(58) Field of Classification Search
CPC ..... B22D 17/10; B22D 17/14; B22D 17/145; B22D 17/20; B22D 17/203; B22D 17/263
USPC ..... 164/284, 303, 305, 312
See application file for complete search history.

(56) References Cited

U.S. PATENT DOCUMENTS

| | | | | |
|---|---|---|---|---|
| 2006/0042773 A1* | 3/2006 | Eisen | B22D 17/14 164/319 |
| 2006/0081310 A1* | 4/2006 | Yokoyama | C22C 45/10 148/403 |
| 2007/0199676 A1* | 8/2007 | Wolter | B22D 17/10 164/516 |

FOREIGN PATENT DOCUMENTS

| | | | |
|---|---|---|---|
| JP | 04-039389 | U1 | 4/1992 |
| JP | 04-262848 | A | 9/1992 |
| JP | 11-47900 | A | 2/1999 |
| JP | 2008-246503 | A | 10/2008 |
| WO | 2005/084909 | A1 | 9/2005 |
| WO | 2006/115141 | A1 | 11/2006 |

* cited by examiner

*Primary Examiner* — Kevin P Kerns
(74) *Attorney, Agent, or Firm* — DLA Piper LLP (US)

(57) ABSTRACT

A die casting machine is provided with a movable platen for holding a movable mold, a stationary platen for holding a stationary mold, and tie bars inserted into insertion holes provided in the movable platen and the stationary platen, the movable platen being arranged so as to be capable of advancing to and retreating from the fixed platen along the tie bars. A hollow section is provided in at least one of the movable platen and the stationary platen.

11 Claims, 15 Drawing Sheets

DIE CASTING MACHINE

FIELD

The present invention relates to a die casting machine, in particular a die casting machine provided with a hollow structure platen.

BACKGROUND

When producing castings made of an aluminum alloy, frequent use is made of a die casting machine performing a method of filling a casting mold with a molten material (molten metal) under pressure. A die casting machine fills molten metal placed in an injection sleeve into a casting mold at a high speed, so is good in productivity and enables castings of large size, thin products. Further, it has the advantage of being able to produce products with a high dimensional accuracy, fine microstructure, and beautiful casting surface. On the other hand, since it charges the molten metal at a high speed, it has the shortcoming of easy entrainment of air and susceptibility to formation of shrinkage defects in the final solidified parts.

In recent years, for die casting machines, it has become necessary to cast large, thin products. So-called "high speed injection" increasing the injection speed has become more frequent. However, if performing high speed injection, the air inside the injection sleeve or at the cavity or the gas generated from a release agent etc. can become entrained and cause casting defects in the products. For this reason, it has become necessary to discharge the air in the injection sleeve or cavity and the generated gas to create a vacuum. In the prior art such as PTL 1, a vacuum tank has been installed in the vicinity of the die casting machine as a separate device from the die casting machine and a vacuum valve etc. has been used to suck out the air in the injection sleeve and cavity. However, since the die casting machine and vacuum tank are separated from each other, the vacuum degree inside the injection sleeve and inside the cavity could not be sufficiently raised.

FIG. 15 is a graph showing the relationship between the distance between a die casting machine and vacuum tank and a pressure reduction curve. Note that, atmospheric pressure is 101.3 kPa. The length of the hose (inside diameter 2 inches) connecting the die casting machine and the vacuum tank is changed to 0.5 m, 5 m, 10 m, and 20 m for analysis to find the pressure reduction curve. As shown in this graph, it is learned that if the distance from the vacuum tank is long, the vacuum degree does not easily rise.

CITATION LIST

Patent Literature

[PTL 1] Japanese Unexamined Patent Publication No. 2008-246503

SUMMARY

Technical Problem

In the prior art, the distance between the inside of a mold or injection sleeve of a die casting machine and a vacuum/high pressure tank is long, so it is not possible to lower a pressure inside the mold or injection sleeve to a predetermined pressure sufficiently fast. The present invention is made in consideration of such a problem of the prior art and enables molten metal of a die casting machine to be filled at a high speed while keeping air or generated gas from being entrained.

Solution to Problem

A die casting machine comprising a movable platen holding a movable die, a stationary platen holding a stationary die, and tie bars inserted through insertion holes provided in the movable platen and the stationary platen and arranging the movable platen on a machine base so as to be able to advance and retract to and from the stationary platen along the tie bars, wherein at least one of the movable platen and the stationary platen is provided with a sealed hollow part.

At least one of the movable platen and the stationary platen is made to have one or more hollow parts.

The hollow part of the at least one of the movable platen and the stationary platen is made to be used as a vacuum tank.

The hollow part of the at least one of the movable platen and the stationary platen is made to be used as a tank for compressed air.

The hollow part of the at least one of the movable platen and the stationary platen is made to be used as a tank for a release agent.

A vacuum pump is made to be fastened to at least one of the movable platen, the stationary platen, the machine base, and a floor.

A vacuum on-off valve is made to be fastened to at least one of the movable platen, the stationary platen, the movable die, and the stationary die.

An autojoint is used to connect the vacuum tank and the vacuum on-off valve.

The autojoint is a coupler and connects the vacuum tank and vacuum on-off valve by a one touch action.

Advantageous Effects of Invention

By using a hollow structure inside a component of a die casting machine, that is, a platen, as a vacuum tank, a high pressure tank, etc., the following advantageous effects can be expected.

(1) A reduction in the installation space can be realized.
(2) Costs can be cut (a separate vacuum tank becomes unnecessary and the piping can be shortened the most).
(3) The invention can be applied not only to a platen fabricated by casting, but also a platen fabricated by machining a hollow part from a rolled material (as often seen in European machines).
(4) By installing a vacuum tank closest to the dies, it is possible to shorten the time until reaching high vacuum. Further, by evacuation from the injection sleeve, the phenomenon of "preceding molten metal" (where if vacuum degree inside cavity becomes higher than vacuum degree inside injection sleeve, molten metal inside injection sleeve is pulled inside cavity before injection) can be prevented.
(5) High vacuum and ultrahigh speed injection becomes possible before inflow of release agent, moisture, and outside air.
(6) Due to the above (4) and (5), it becomes possible to reduce casting defects such as blowholes and stripped marks.

DESCRIPTION OF EMBODIMENTS

Figure 1:
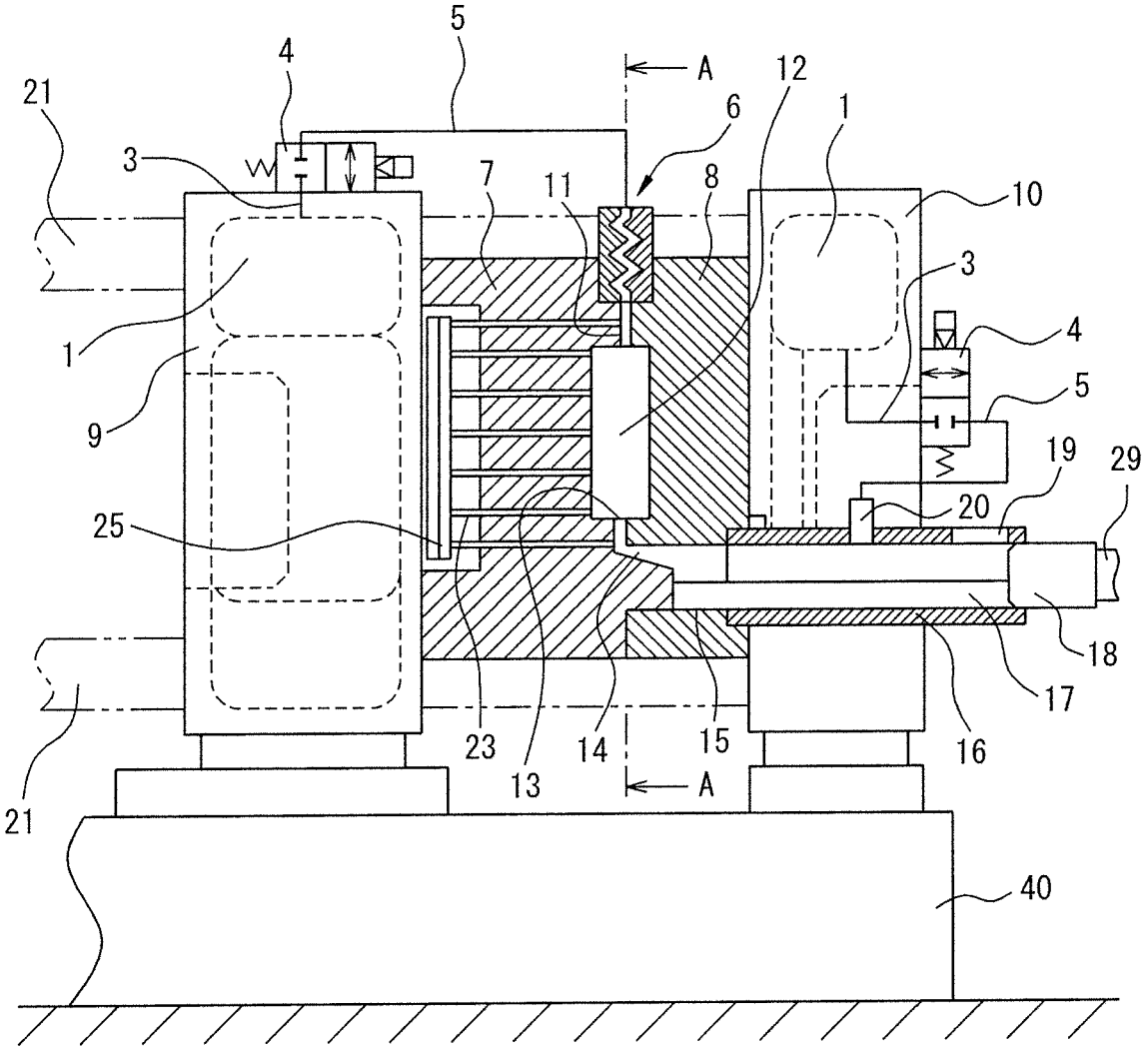
FIG. 1 is a side view of a die casting machine comprising platens provided with hollow parts in an embodiment of the present invention.
Figure 2:
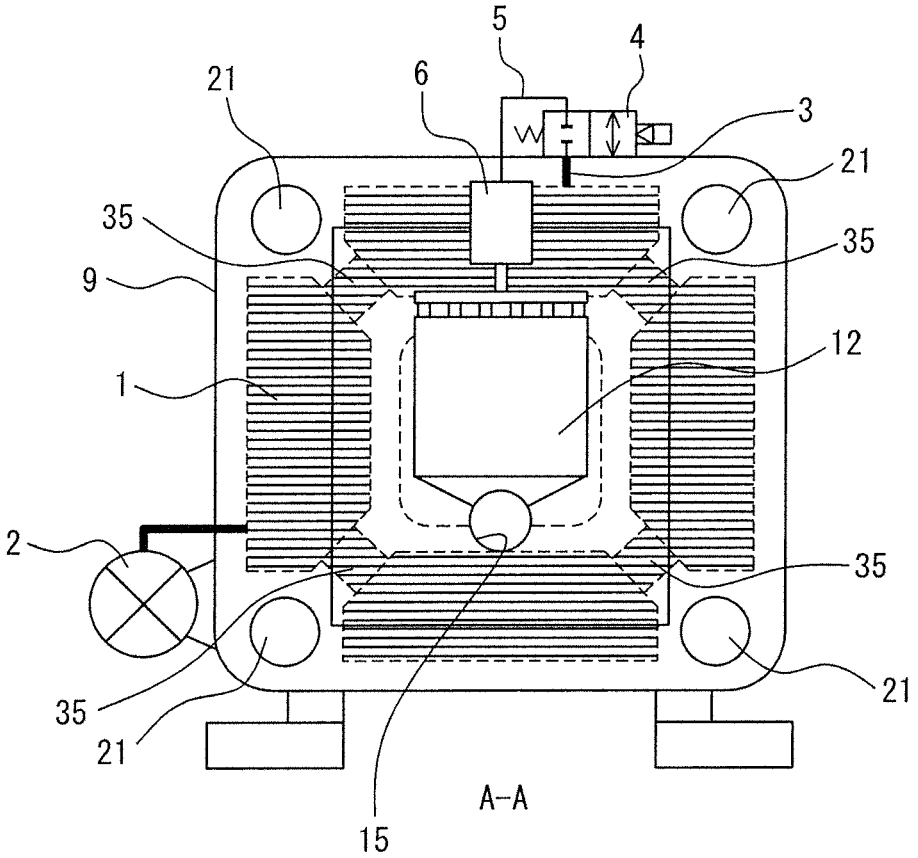
FIG. 2 is a front cross-sectional view taken along the line A-A of FIG. 1.
Figure 3:
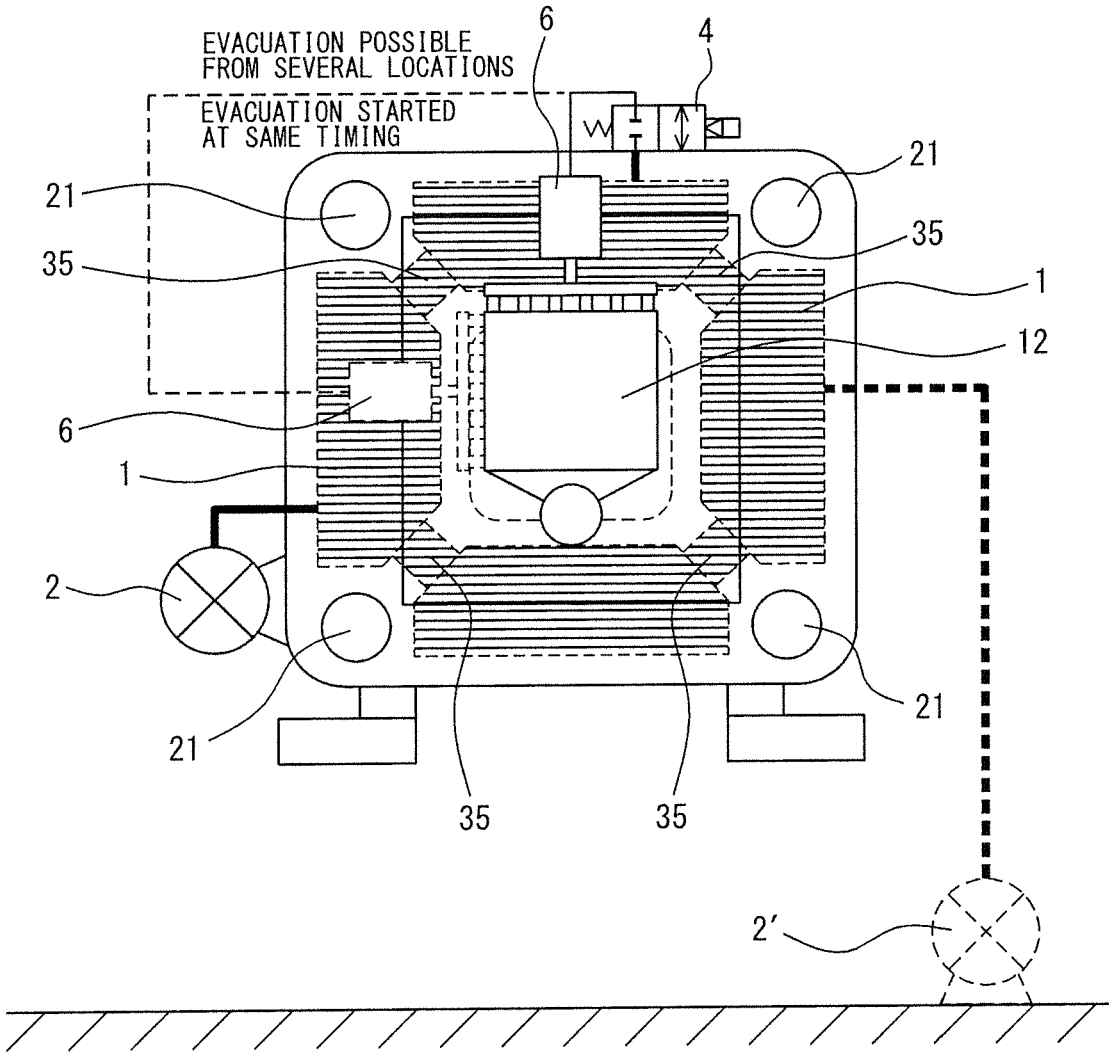
FIG. 3 is an explanatory view of the time when using a hollow part as a main tank for vacuum in one embodiment of the present invention.
Figure 4A:
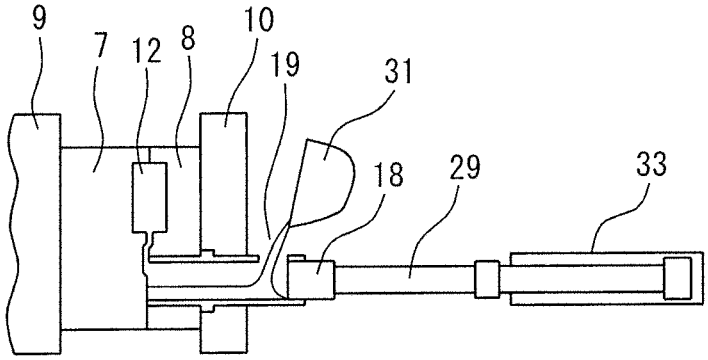
FIGS. 4(*a*) to (*e*) are explanatory views for explaining an injection process in one embodiment.
Figure 4B:
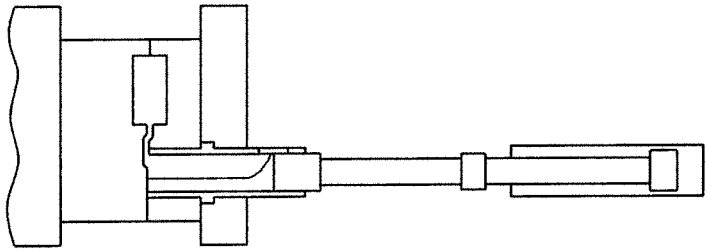
Figure 4C:
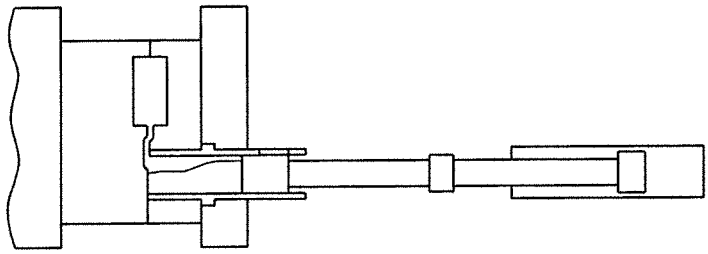
Figure 4D:
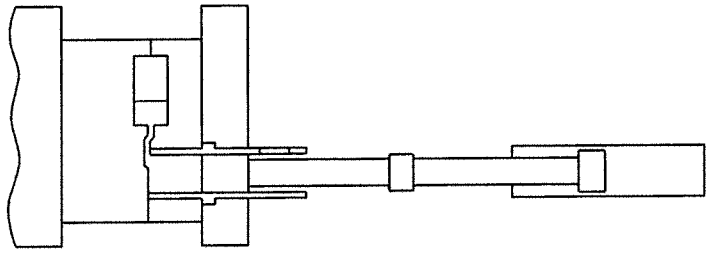
Figure 4E:
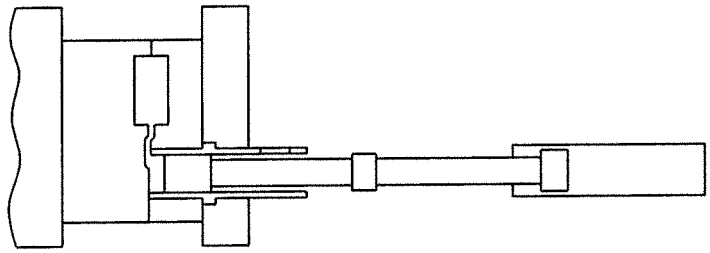

FIG. 1 is a side view of a die casting machine comprising platens provided with hollow parts in one embodiment of the present invention. FIG. 2 is a cross-sectional view taken along the line A-A of FIG. 1. FIG. 3 is an explanatory view of the time when using hollow parts as main tanks for vacuum in one embodiment of the present invention. First, referring to the side view of FIG. 1, a die casting machine of the present embodiment will be explained in brief.

In the die casting machine, a movable die 7 is installed at a movable platen 9, while a stationary die 8 is installed at a stationary platen 10. The movable platen 9 is made to move toward the stationary platen 10 over a machine base 40 placed on a floor by a toggle link or ball-screw mechanism or other force multiplication mechanism. Due to this, the movable die 7 and the stationary die 8 are clamped and a cavity 12 is formed. In the movable platen 9 and the stationary platen 10, four tie bars 21 are inserted through insertion holes. The movable platen 9 moves along the tie bars 21 to be able to advance toward and retract from the stationary platen 10. By making the stationary die 8 and movable die 7 engage as shown in FIG. 1, the cavity (for forming a product) 12 is formed between them. The cavity 12 is injected and filled with aluminum (Al) or another molten metal 17 to produce a cast shape.

The stationary platen 10 is provided with an injection sleeve 16. The injection sleeve 16 fits into a hole provided in the stationary die 8 to form a shot chamber. To inject aluminum molten metal 17, an injection cylinder 33 (FIG. 4(*a*)) is provided. This is connected with the cavity 12 through a runner 14 and a gate 13. A ladler 31 (FIG. 4(*a*)) pours molten metal 17 from a pouring hole 19, then a plunger tip 18 injects the molten metal 17 and fills the inside of the cavity 12. The plunger tip 18 is connected by a cylinder rod 29 to an injection cylinder 33.

FIGS. 4(*a*) to (*e*) are explanatory views for explaining an injection process in the embodiment. In FIG. 4(*a*), the ladler 31 pours the molten metal 17 from a pouring hole 19 set at the injection sleeve 16. As seen in FIGS. 4(*b*) to (*d*), the injection cylinder 33 then operates. The plunger tip 18 at the front end of the cylinder rod 29 injects the molten metal 17 placed inside the shot chamber from the runner 14 and gate 13 and fills the molten metal 17 in the cavity 12 as shown in FIG. 4(*d*). After that, the molten metal 17 is cooled inside the mold. When sufficiently solidified, the movable platen 7 is returned to its original position and the mold is opened. When the mold is opened, a plurality of ejector pins 23 attached to an ejector pin plate 25 advance by a not shown hydraulic mechanism and the product is extracted.

As explained above, inside of the movable platen 9 and the stationary platen 10, there are spaces serving as the hollow parts. These act as airtight tanks (vacuum tanks 1). In FIGS. 2, 3, etc., the vacuum tanks 1 are shown by hatching. FIG. 2 is a front cross-sectional view taken along line A-A of FIG. 1. Viewing this, there are four box-shaped spaces (vacuum tanks 1) at the top, bottom, left, and right inside of the movable platen 9. The adjoining vacuum tanks 1 are connected each other by pipe-shaped connecting parts 35. The stationary platen 10 is also configured in the same way as the movable platen 9. All of these connected spaces have functions as vacuum tanks. The movable platen 9 and the stationary platen 10 respectively have vacuum pumps 2 attached to them. The vacuum pumps 2 suck out the air of the vacuum tanks 1 inside of the platens to create a vacuum.

In the circuit for sucking out the air inside of the cavity 12, a vacuum runner 11 has vacuum valves or chill vents 6 attached to it for preventing outflow of the molten metal 17. The die casting machine of the present embodiment is one based on the vacuum die casting method, so the vacuum valve or chill vent 6 (see reference sign 6 in FIG. 1) is provided. The vacuum valve is one type of shutoff valve and, for example, is configured so that the molten metal strikes the bottom of the valve to close the valve. It prevents the molten metal from flying off to the outside of the mold. The chill vent 6 is frequently used when fabricating a shaped product of a light metal by the high pressure die casting method and means a chiller used for venting gas. When venting gas of the cavity 12, outflow of the molten metal 17 is prevented by the chill vent 6. The chill vent 6 are formed in a pair of blocks which are respectively fastened to the movable die 7 and the stationary die 8. They separate when the mold is opened. The span from the vacuum valve or chill vent 6 to a vacuum on-off valve 4 attached to the movable platen 9 is connected by a first vacuum pipeline 5, while the span from the vacuum on-off valve 4 to a space inside the platen is connected by a second vacuum pipeline 3. Further, to suck out the air inside of the injection sleeve 16, the injection sleeve 16 has a sleeve vacuum suction port 20 attached to it. The span from the sleeve vacuum suction port 20 to the vacuum on-off valve 4 is connected by the first vacuum pipeline 5, while the span from the vacuum on-off valve 4 to the space of the hollow part 1 of the platen is connected by the second vacuum pipeline 3. Note that, the piping is preferably thick, but in practice is about 1 inch (2.54 cm) in size.

In the embodiment shown in FIG. 3, a configuration using the vacuum tanks 1 as main tanks for vacuum will be explained. In FIG. 3, there are a total of four vacuum tanks 1—one each at the top, bottom, left, and right. The respective vacuum tanks 1 are connected by connecting parts 35. The cavity 12 is connected with vacuum valves or chill vents 6 and is configured so that air inside the cavity 12 is sucked out. In the embodiment shown in FIG. 3, two vacuum valves or chill vents 6 are connected to the single vacuum on-off valve 4 by solid lines and broken lines. Alternatively, a single vacuum valve or chill vent 6 may also be connected to a single vacuum on-off valve 4. A single vacuum valve or chill vent 6 may also be connected to a plurality of vacuum tanks 1 not connected with each other by connecting parts 35 or a plurality of vacuum on-off valves 4. Further, how vacuum on-off valves 4 are connected to top, bottom, left, and right vacuum tanks 1 not connected by connecting parts 35 may be suitably freely set. The vacuum pumps 2, 2' may be fastened to the platens or may be fastened to the floor or fastened to the machine base (when not desiring to make them operate together with the platens)—two methods. Further, a single vacuum on-off valve 4 may be used to establish a vacuum using a plurality of vacuum tanks 1 not connected with other at connecting parts 35 at the same timing.

Figure 5:
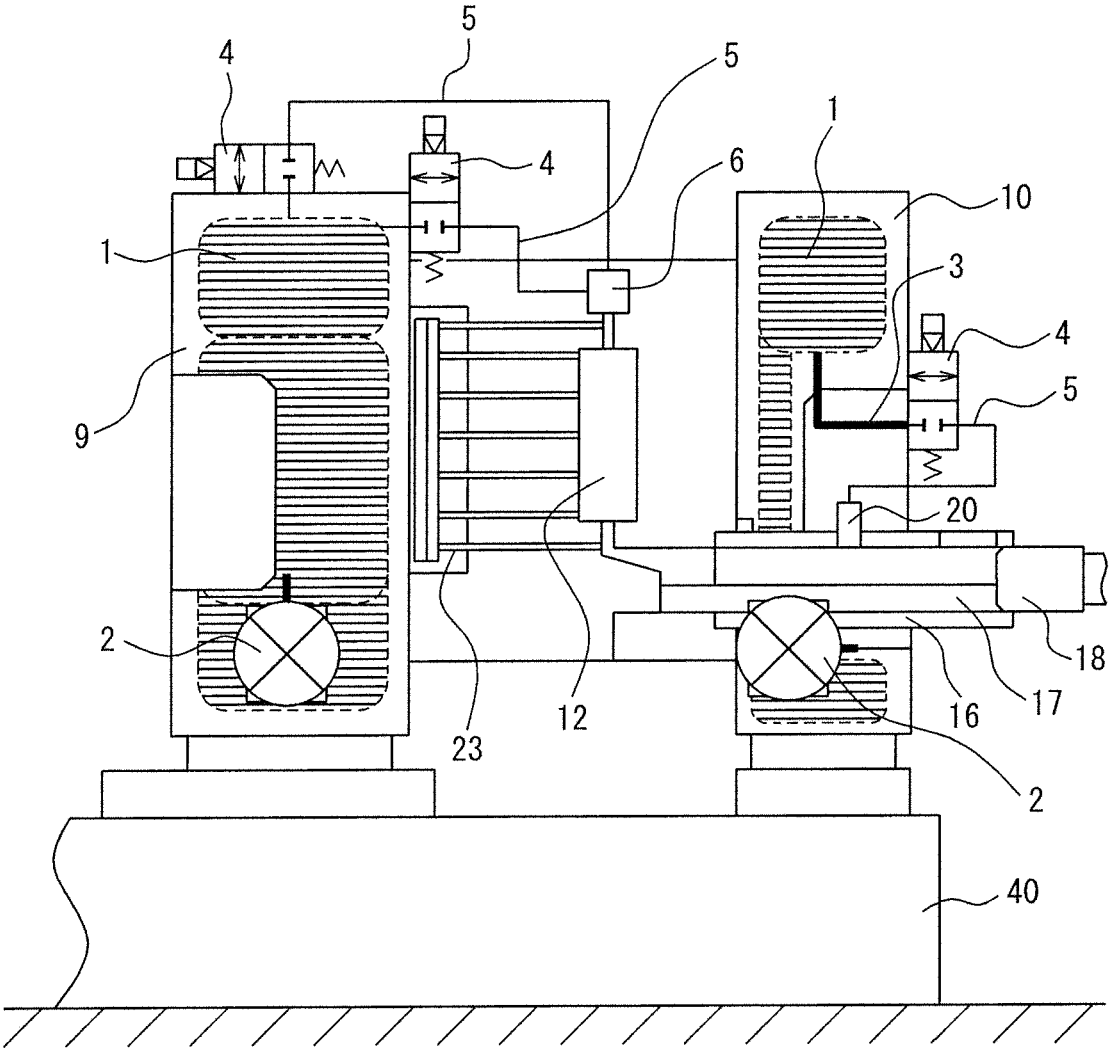
FIG. 5 is an explanatory view showing an installation position of a vacuum on-off valve in one embodiment of the present invention.
Figure 6:
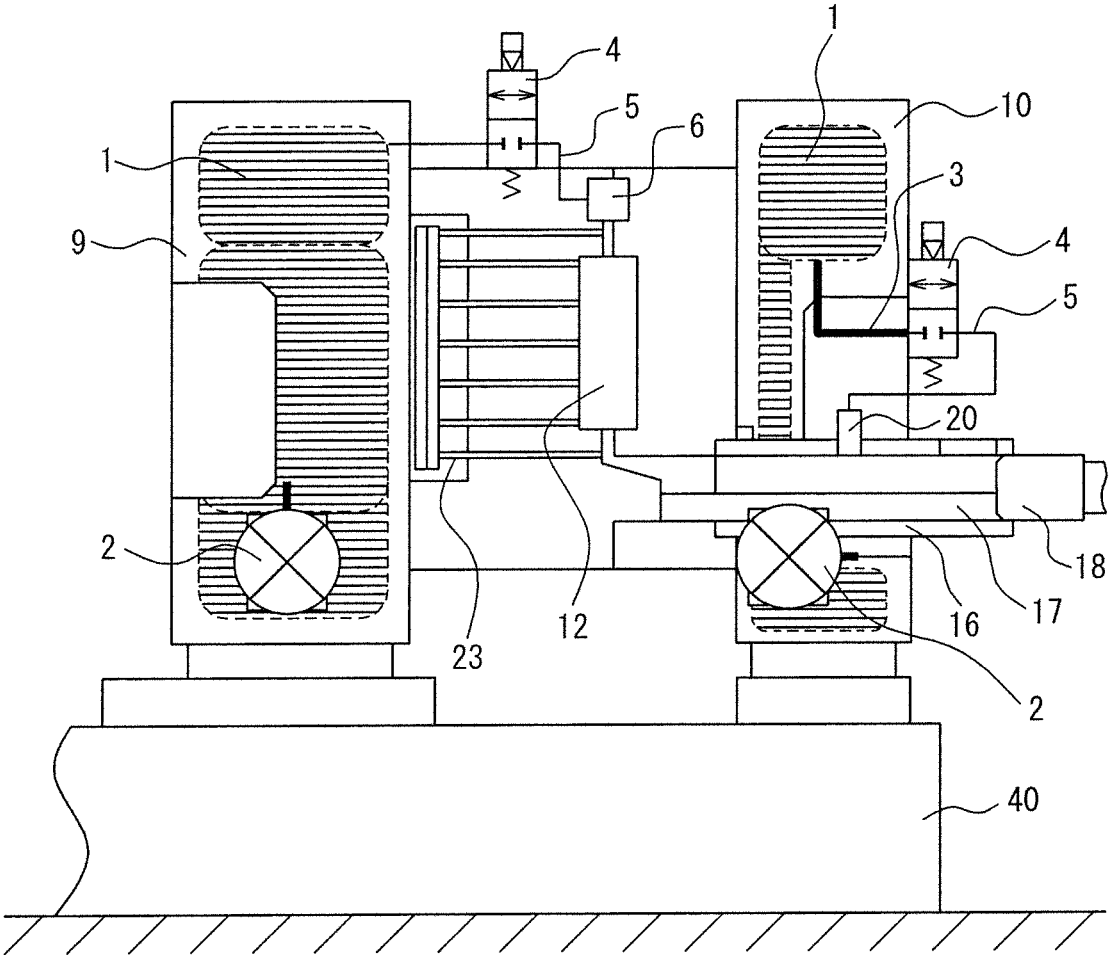
FIG. 6 is an explanatory view showing another installation position of a vacuum on-off valve in one embodiment of the present invention.
Figure 7:
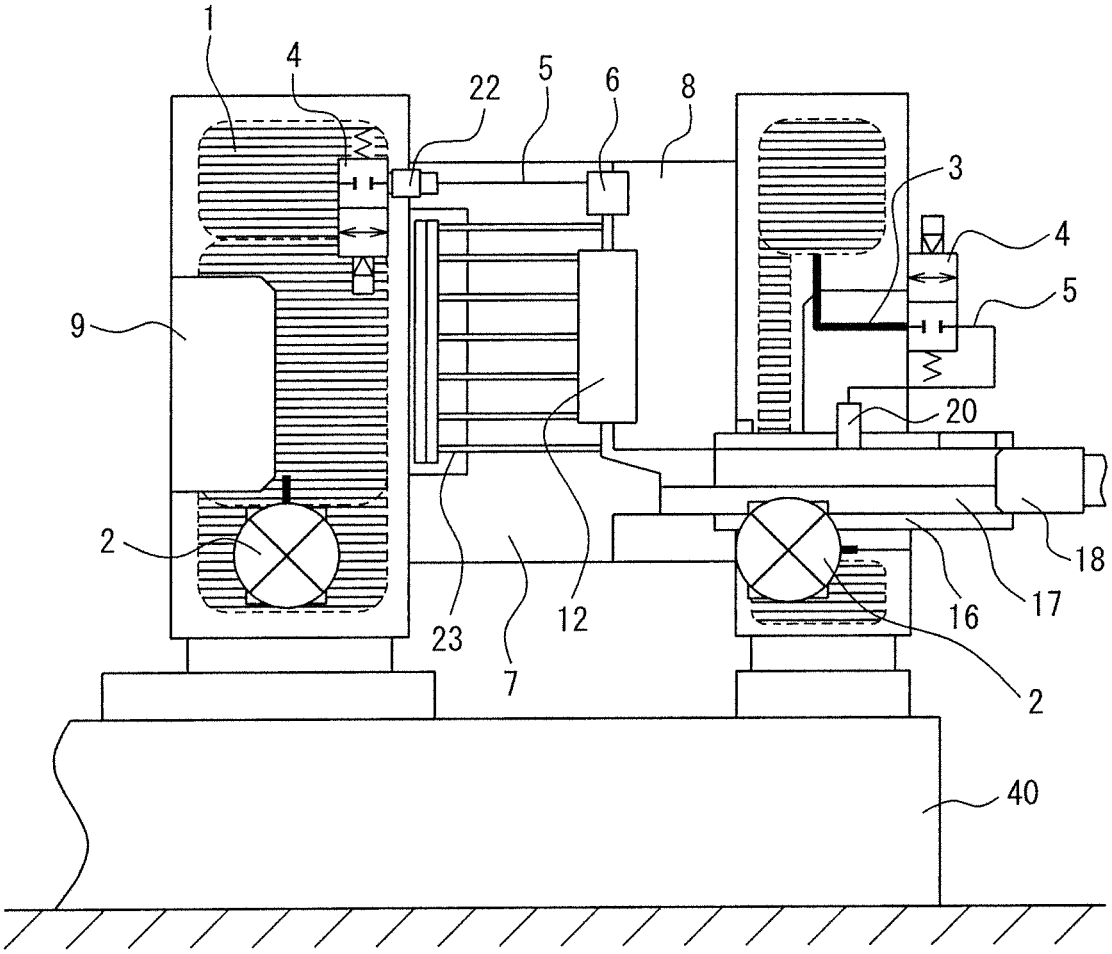
FIG. 7 is an explanatory view of using an autojoint to enable a vacuum line to be connected in one embodiment of the present invention.

Referring to FIGS. 5 to 7, embodiments in cases of different installation positions of the vacuum on-off valves 4 will be explained. In the embodiment shown in FIG. 5, the installation positions of the vacuum on-off valves 4 are the top surface, side surface and the mold mounting surface of the platens. Further, in the embodiment of FIG. 7, the vacuum on-off valve 4 is attached to the inside of the vacuum tank 1. In the embodiment shown in FIG. 6, the installation positions of the vacuum on-off valves 4 are the top surface and side surface of the mold. In the case of FIG. 6, the vacuum on-off valve 4 is installed at the position of the movable die 7, but it may also be installed at the stationary die 8. In this case, installing the vacuum on-off valve 4 at the mold enables maintenance each time changing the mold. The installation position of the vacuum on-off valve 4 can also be freely selected from positions other than the above.

As seen in FIG. 7, an embodiment using an autojoint 22 to connect vacuum lines at the same time as attaching the mold will be explained. An autojoint (also called an "auto-coupler") is a joint often used in die casting machines, injection molding machines, etc. In the case of attaching the movable die to the movable platen or attaching the stationary die to the stationary platen, it connects the pipeline 5 to the vacuum tank 1 and vacuum on-off valve 4 at the same time as attaching the mold. An autojoint 22 comes in various forms, but one example will be explained by FIGS. 8(*a*) and (*b*).

Figure 8A:
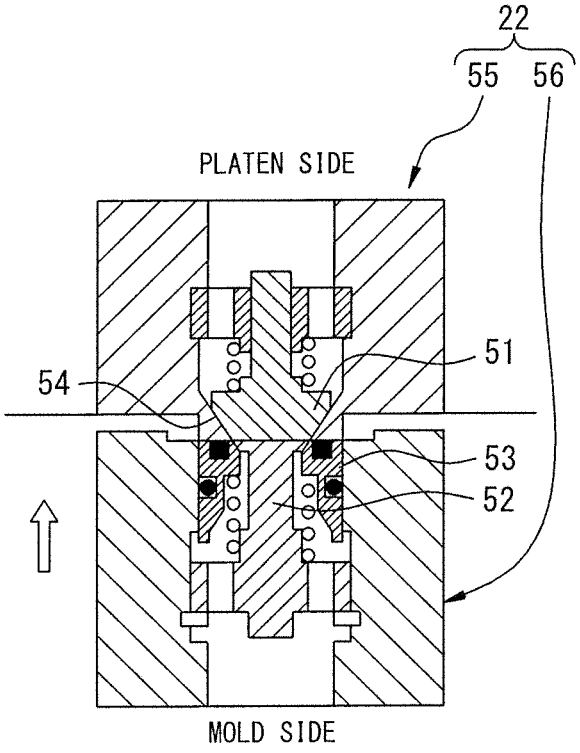
FIGS. 8(*a*) and (*b*) are views explaining one example of an autojoint, wherein (a) shows the state before connection of the autojoint and (b) shows the state after connection.
Figure 8B:
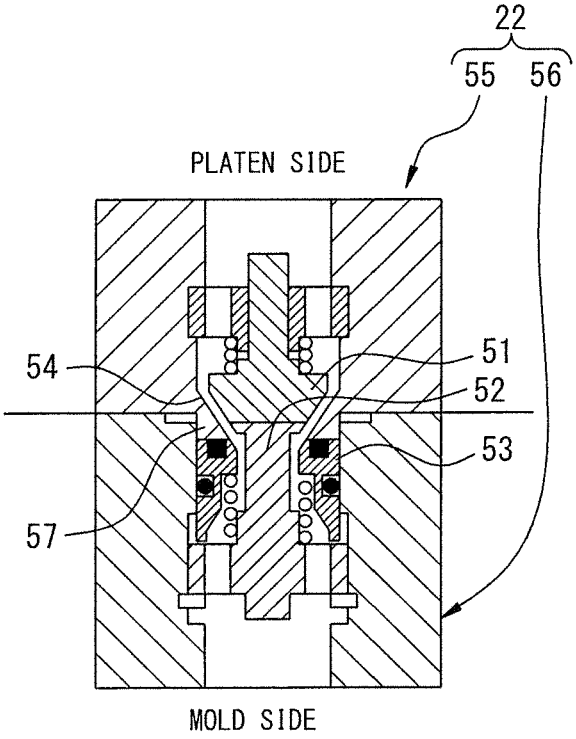

FIG. 8(*a*) shows the state where a platen side unit 55 and a mold side unit 56 are separated and are not pressing against each other. In FIG. 8(*a*), a valve 51 is pressed against the platen side unit 55 by a spring to close it. Similarly, a valve 52 is fastened to the mold side unit 56. A sleeve 53 is pressed by a spring to close the channel between the valve 52 and sleeve 53. The platen side unit 55 and the mold side unit 56 are guided by taper pins or other positioning mechanisms whereby the two approach each other as shown in FIG. 8(*b*).

FIG. 8(*b*) shows the state where the mold side unit 56 is attached to the platen side unit 55. In that state, the valve 52 is fastened to the mold side unit 56, so the valve 51 of the platen side unit 55 retracts. At the same time as this, a projecting part 57 of the platen side unit 55 makes the sleeve 53 retract. Due to this, a clearance is formed between a valve seat 54 and the valves 51, 52 and a channel is opened. Note that, the platen side unit 55 and the mold side unit 56 here may also be conversely attached to the mold side and platen side. The autojoint is not limited to the example of FIG. 8. Various other connections may be applied.

In the embodiment shown in FIG. 7, the autojoint 22 is set between the back surface of the movable die 7 and the movable platen surface so as to connect the vacuum line as is by a one-touch action at the same time as attachment of the mold. The autojoint can be set at the movable die 7 or at the stationary die 8 however. The autojoint is preferably one like a coupler which enables connection by a one-touch action, but may also be one similar to the same. As a result, the mold setup time is shortened and simultaneously missed connection and other human error can be avoided.

Figure 9:
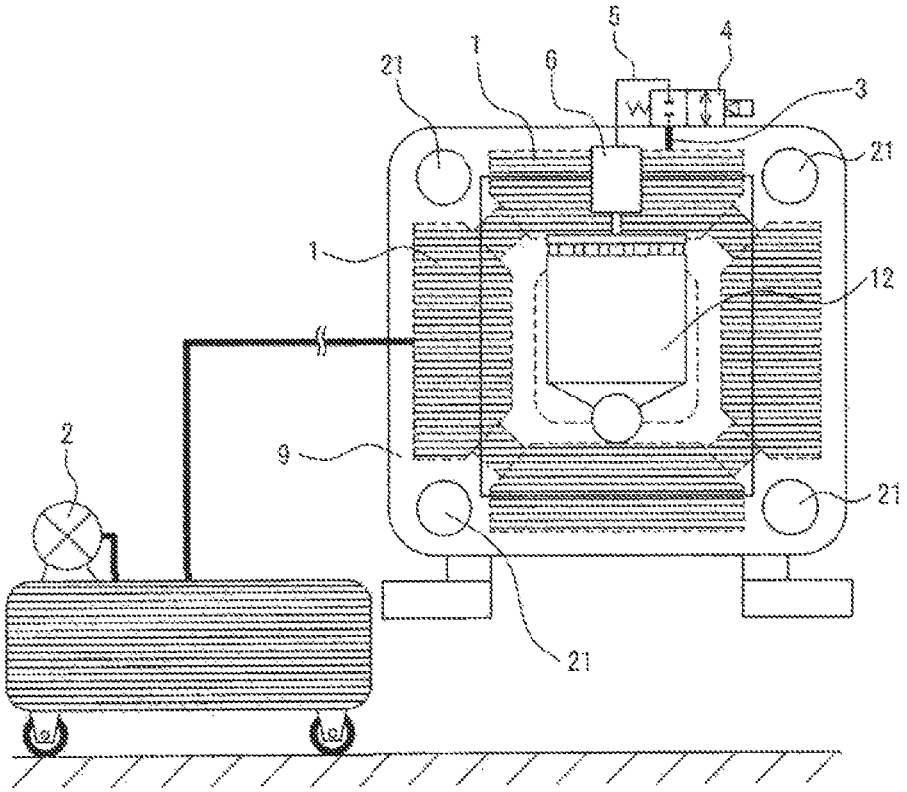
FIG. 9 is an explanatory view of a case of joint use of a conventional vacuum device and platens of the present invention in one embodiment of the present invention.

FIG. 9 shows an embodiment in a case of jointly using hollow parts 1 set in a platen such as in the device of the present invention and a conventional vacuum device. A conventional vacuum device may be installed far from the mold, so the degree of freedom of placement of the vacuum device is increased. Further, vacuum tanks 1 can be added nearest to the platen. Due to this, the initial inclination of evacuation curve is improved, so a high vacuum can be achieved in a shorter time. High vacuum and ultrahigh speed injection becomes possible before the inflow of the release agent, moisture, and the outside air. As a result, blowhole defects are reduced and the casting surface is improved.

Figure 10:
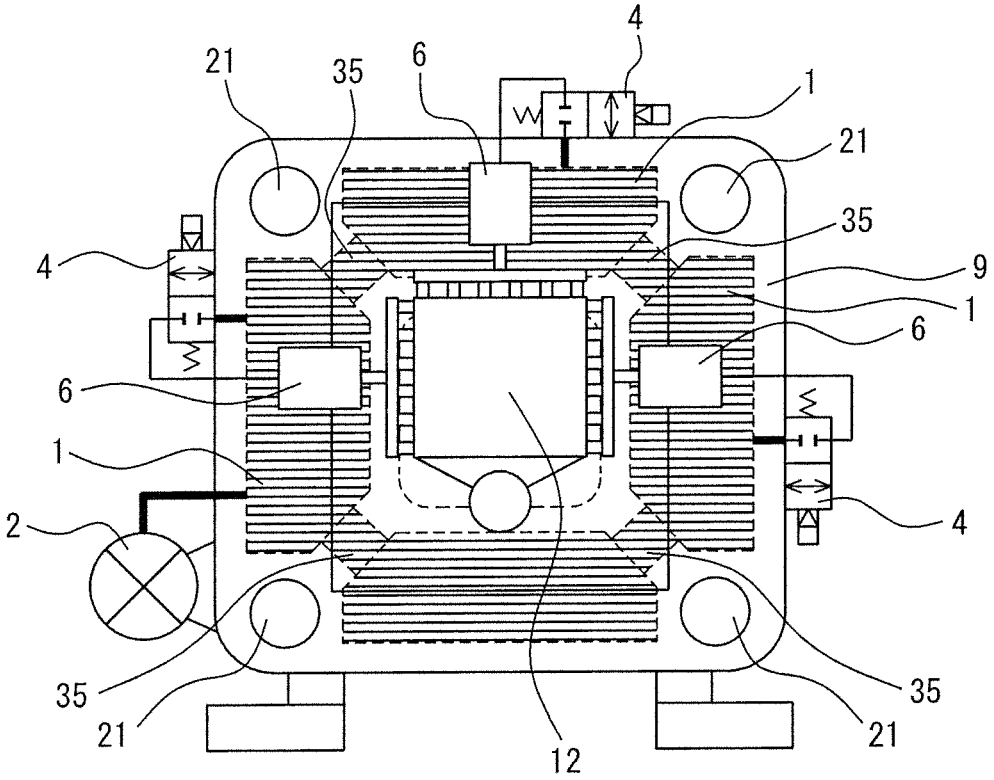
FIG. 10 is an explanatory view of a case of dealing with a plurality of vacuum systems in one embodiment of the present invention.

FIG. 10 shows an embodiment which can easily accommodate a plurality of vacuum systems. As shown in FIG. 10, a plurality of vacuum valves 4 or chill vents 6 are attached to enable evacuation from a plurality of locations. As a result, poor quality locations can be evacuated with priority. The timing of start of evacuation can be changed at different portions. That is, it is possible to operate the vacuum on-off valves 4 to match the molten metal flow inside the cavity 12.

Figure 11:
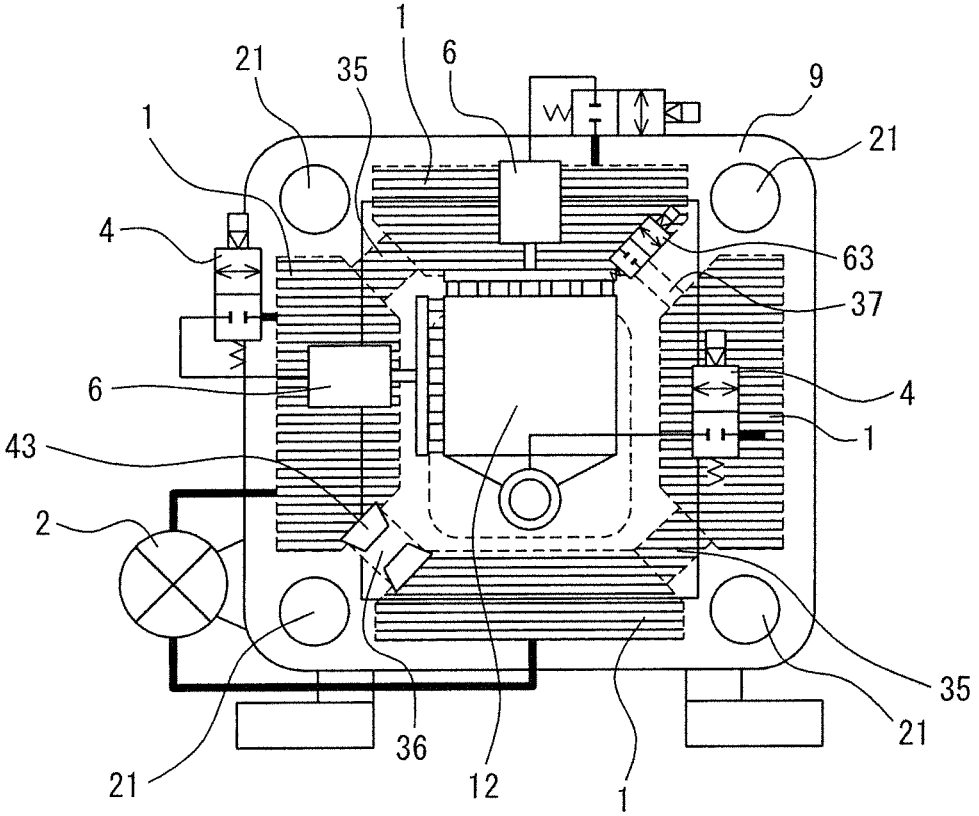
FIG. 11 is an explanatory view of a case of using a hollow part divided into a plurality of independent vacuum tanks in one embodiment of the present invention.

FIG. 11 shows an embodiment in a case of use of hollow parts divided into a plurality of independent vacuum tanks 1. For the method of division into vacuum tanks 1, division is possible at the time of producing the platen casting by setting whether to make the connecting parts 35 connecting spaces. Further, it is possible to close the holes by using plugs 43 at the connecting parts 36 or using solenoid valves 63 etc. at the connecting parts 37. In this case, it is possible to operate the solenoid valves 63 so as to connect or disconnect adjoining vacuum tanks 1.

Figure 12:
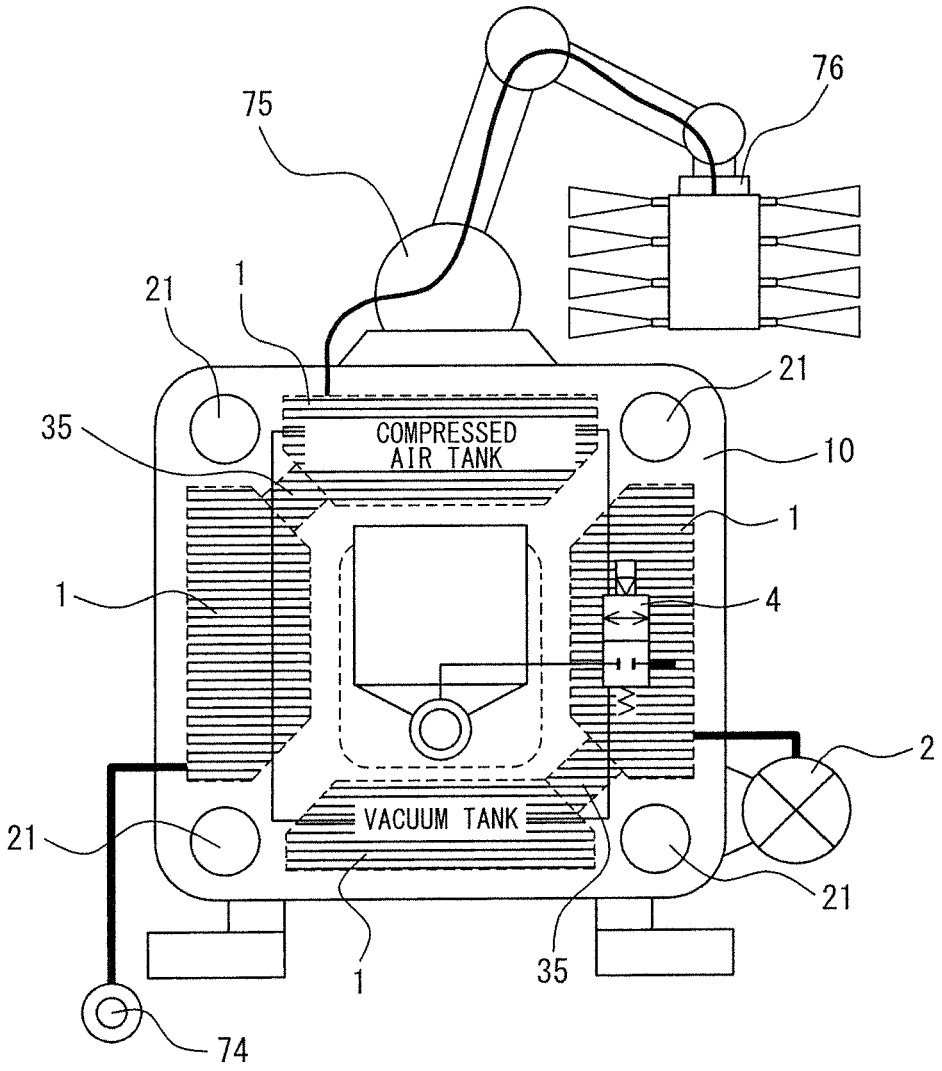
FIG. 12 is an explanatory view of a case of using a hollow part as a vacuum tank and an air reserve tank for compressed air in another embodiment of the present invention.

FIG. 12 is an embodiment showing that use of hollow parts is possible as not only a vacuum tank, but also a compressed air tank. For example, hollow parts 1 connected from an air source 74 can be used as a reserve tank of an air line for a spray system. At this time, use is made of the hollow parts as a tank for storing compressed air. On the other hand, the remaining parts are used as a vacuum tank 1. Reference numeral 75 denotes a spray robot, while 76 denotes a spray head.

Figure 13:
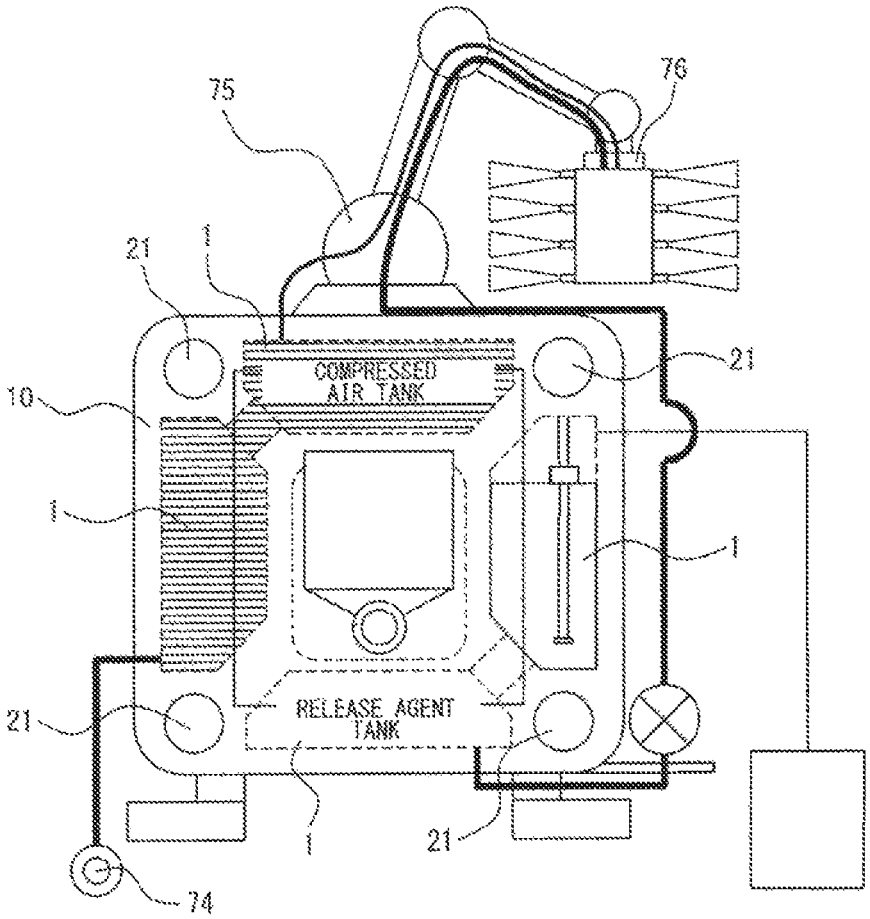
FIG. 13 is an explanatory view of a case of using a hollow part as an air reserve tank for compressed air and a tank for a release agent in another embodiment of the present invention.

FIG. 13 is an embodiment showing that use of hollow parts is possible as tanks not only for a gas but also for a liquid. For example, use is also possible as a tank for air for a spray system and a tank for supply of a release agent. Further, while not shown, it is also possible to attach a vacuum tank, compressed air tank, and release agent tank at a single platen in at least one of the movable platen 9 and stationary platen 10.

Figure 14:
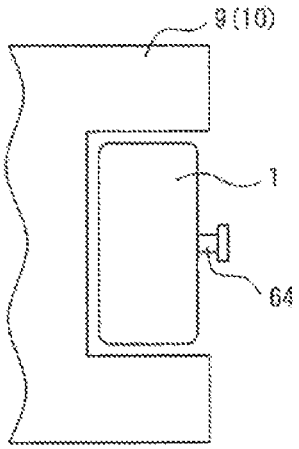
FIGS. 14(*a*) to (*c*) are explanatory views illustrating different forms of a hollow part in one embodiment of the present invention.
Figure 14:
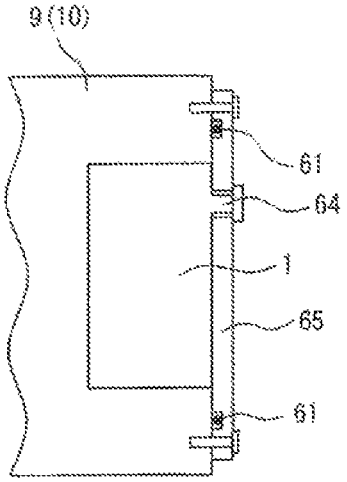
Figure 14:
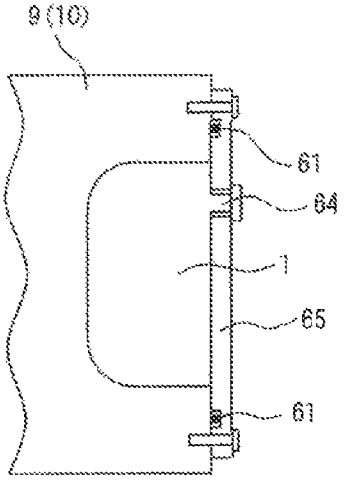
Figure 15:
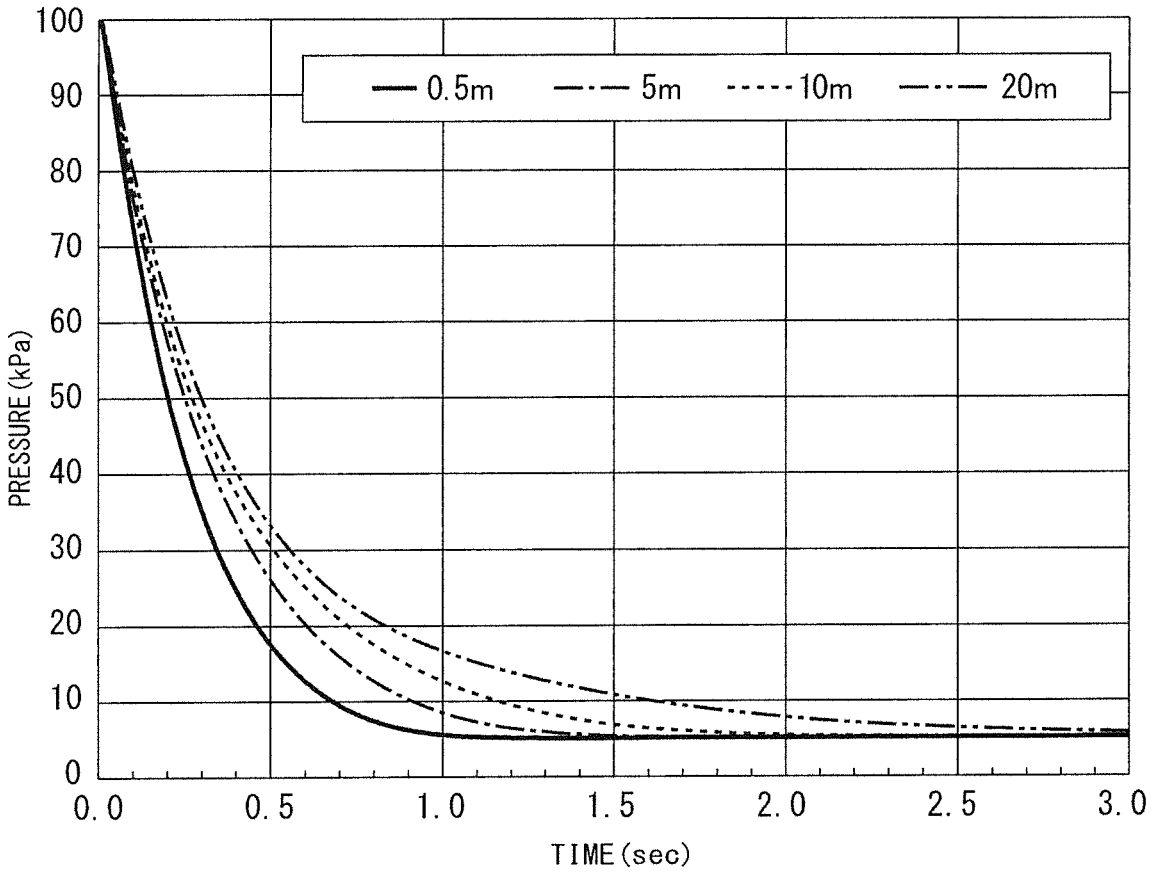
FIG. 15 is a graph showing a relationship between a distance between a die casting machine and vacuum tank and a pressure reduction curve.

FIGS. 14(*a*) to (*c*) are explanatory views illustrating different forms of a hollow part in embodiments of the present invention. In the embodiment of FIG. 14(*a*), the hollow part 1 is comprised of a space formed in the movable platen 9 or stationary platen 10 configured to hold a separate sealed vacuum tank 1. The movable platen 9 or stationary platen 10 in this case may be a platen formed by casting or may be one fabricated by machining a rolled material. The hollow part 1 may be an as-cast recess or may be a cast recess which is further machined. In the embodiment of FIG. 14(*b*), the hollow part 1 is formed by machining the movable platen 9 or stationary platen 10. The space formed by the machining is sealed by a lid 65 to form the hollow part. A takeout port 64 is provided in the lid 65. Reference numeral 61 denotes a seal member. In the embodiment of FIG. 14(*c*), the hollow part 1 is comprised of a hollow space formed in the movable platen 9 or stationary platen 10 by casting. In the case of a cast platen, the end face is machined flat, the space is sealed by a lid 65 to form the hollow part, and a takeout port 64 is provided in the lid 65. Reference numeral 61 denotes a seal member. The hollow part 1 may be an as-cast recess or may be a cast recess which is further machined to form a space for use.

Note that, the technical scope of the present invention is not limited to the above embodiments and includes various changes made to the above embodiments within a range not deviating from the gist of the present invention. That is, the specific constitutions mentioned in the embodiments are just illustrations and can be suitably changed.

Above, the explanation is given regarding die casting machines, but the present constitution can also be utilized for platens of injection molding machines or extrusion presses.

The present invention gives rise to the following effects due to the above constitution:

(1) A reduction in the installation space can be realized.

(2) Costs can be cut (a separate vacuum tank becomes unnecessary and the piping can be shortened the most).

(3) The invention can be applied not only to a platen fabricated by casting, but also a platen fabricated by machining a hollow part from a rolled material (as often seen in European machines).

(4) By installing a vacuum tank closest to the dies, it is possible to shorten the time until reaching high vacuum. Further, by evacuation from the injection sleeve, the phenomenon of "preceding molten metal" (where if vacuum degree inside cavity becomes higher than vacuum degree inside injection sleeve, molten metal inside injection sleeve is pulled inside cavity before injection) can be prevented.

(5) High vacuum, ultrahigh speed injection becomes possible before inflow of release agent, moisture, and outside air.

(6) Due to the above (4) and (5), it becomes possible to reduce casting defects such as blowholes and stripped marks.

REFERENCE SIGNS LIST

1 vacuum tank
2 vacuum pump
3 second vacuum pipeline
4 vacuum on-off valve
5 first vacuum pipeline
6 vacuum valve or chill vent
7 movable die
8 stationary die
9 movable platen
10 stationary platen
11 vacuum runner
12 cavity (for forming a product)
13 gate
14 runner
15 die sleeve
16 injection sleeve
17 molten metal
18 plunger tip
19 pouring hole
20 sleeve vacuum suction port
21 tie bar
22 autojoint

The invention claimed is:

1. A die casting machine comprising a movable platen holding a movable die, a stationary platen holding a stationary die, and tie bars inserted through insertion holes provided in the movable platen and the stationary platen and arranging the movable platen on a machine base to be able to advance and retract to and from the stationary platen along the tie bars, wherein a sealed hollow part is included inside at least one of the movable platen and the stationary platen, and wherein the sealed hollow part is a vacuum tank.

2. The die casting machine according to claim 1, wherein at least one of the movable platen and the stationary platen has one or more hollow parts.

3. The die casting machine according to claim 1, wherein a vacuum pump is fastened to at least one of the movable platen, the stationary platen, the machine base, and a floor.

4. The die casting machine according to claim 3, wherein a vacuum on-off valve is fastened to the at least one of the movable platen, the stationary platen, the movable die, and the stationary die.

5. The die casting machine according to claim 1, wherein a first vacuum pipeline connecting to the vacuum tank and a second vacuum pipeline connecting to a cavity formed by the movable die and the stationary die are connected by a coupler at the same time as attaching the movable die or the stationary die, respectively, to the movable platen and the stationary platen.

6. The die casting machine according to claim 5, wherein the coupler is a one-touch connecting autojoint.

7. The die casting machine according to claim 1, wherein the hollow part is a hollow space formed in the movable platen or the stationary platen configured to accommodate a separate vacuum tank.

8. The die casting machine according to claim 1, wherein the hollow part is formed in the movable platen or the stationary platen by machining.

9. The die casting machine according to claim 1, wherein the hollow part is formed in the movable platen or the stationary platen by casting.

10. A die casting machine comprising a movable platen holding a movable die, a stationary platen holding a stationary die, and tie bars inserted through insertion holes provided in the movable platen and the stationary platen and arranging the movable platen on a machine base to be able to advance and retract to and from the stationary platen along the tie bars, wherein a sealed hollow part is included inside at least one of the movable platen and the stationary platen, and the sealed hollow part of the at least one of the movable platen and the stationary platen is a compressed air tank.

11. A die casting machine comprising a movable platen holding a movable die, a stationary platen holding a stationary die, and tie bars inserted through insertion holes provided in the movable platen and the stationary platen and arranging the movable platen on a machine base to be able to advance and retract to and from the stationary platen along the tie bars, wherein a sealed hollow part is included inside at least one of the movable platen and the stationary platen, and the sealed hollow part of the at least one of the movable platen and the stationary platen is a release agent tank.

* * * * *